US010822776B2

(12) United States Patent
Blattner et al.

(10) Patent No.: US 10,822,776 B2
(45) Date of Patent: Nov. 3, 2020

(54) CONNECTION SOCKET FOR SANITARY FITTING WITH FLOOR-STANDING FAUCET COLUMN

(71) Applicant: Hansgrohe SE, Schiltach (DE)

(72) Inventors: Joachim Blattner, Haslach (DE); Markus Kleinbub, Wolfach (DE)

(73) Assignee: Hansgrohe SE, Schiltach (DE)

( * ) Notice: Subject to any disclaimer, the term of this patent is extended or adjusted under 35 U.S.C. 154(b) by 120 days.

(21) Appl. No.: 15/670,325

(22) Filed: Aug. 7, 2017

(65) Prior Publication Data

US 2018/0044897 A1 Feb. 15, 2018

(30) Foreign Application Priority Data

Aug. 9, 2016 (DE) ..... 10 2016 214 777

(51) Int. Cl.

| | |
|---|---|
| ***E03C 1/02*** | (2006.01) |
| ***E03C 1/10*** | (2006.01) |
| ***E03C 1/04*** | (2006.01) |

(52) U.S. Cl.

CPC ..... *E03C 1/021* (2013.01); *E03C 1/106* (2013.01); *E03C 2001/0416* (2013.01); *E03C 2201/60* (2013.01)

(58) Field of Classification Search

CPC ..... E03C 1/021; E03C 1/106; E03C 2201/60; E03C 2001/0416; Y10T 137/86815

(Continued)

(56) References Cited

U.S. PATENT DOCUMENTS 4,624,415 A * 11/1986 Hofstetter, Jr. ..... E03C 1/021 239/590.3
5,056,562 A * 10/1991 Pawelzik ..... E03C 1/06 137/801

(Continued)

FOREIGN PATENT DOCUMENTS

CN 104704175 A 6/2015
CN 104806781 A 7/2015

(Continued)

OTHER PUBLICATIONS

Partial European Search Report issued in connection with European Patent application No. 17184892.2, dated Jan. 17, 2018, 17 pages.

(Continued)

*Primary Examiner* — Jessica Cahill
*Assistant Examiner* — Patrick C Williams
(74) *Attorney, Agent, or Firm* — Faegre Drinker Biddle & Reath LLP

(57) ABSTRACT

A connection socket is adapted for a sanitary fitting with a floor-standing faucet column and has a socket bottom body and a removably attached socket top. A bottom body fluid channel has a bottom body inlet and a bottom body outlet. The socket top has a top-side connection surface for the faucet column and a top fluid channel with a top inlet in fluid communication with the bottom body outlet. A sound absorber element in the bottom body fluid channel is insertable and extractable via the bottom body outlet and/or a backflow preventer element in the top fluid channel is insertable and extractable via the top outlet. The socket top can be turnable on the socket bottom body between the operating position and a blocking position in which fluid communication is blocked.

18 Claims, 4 Drawing Sheets

Figure 1:
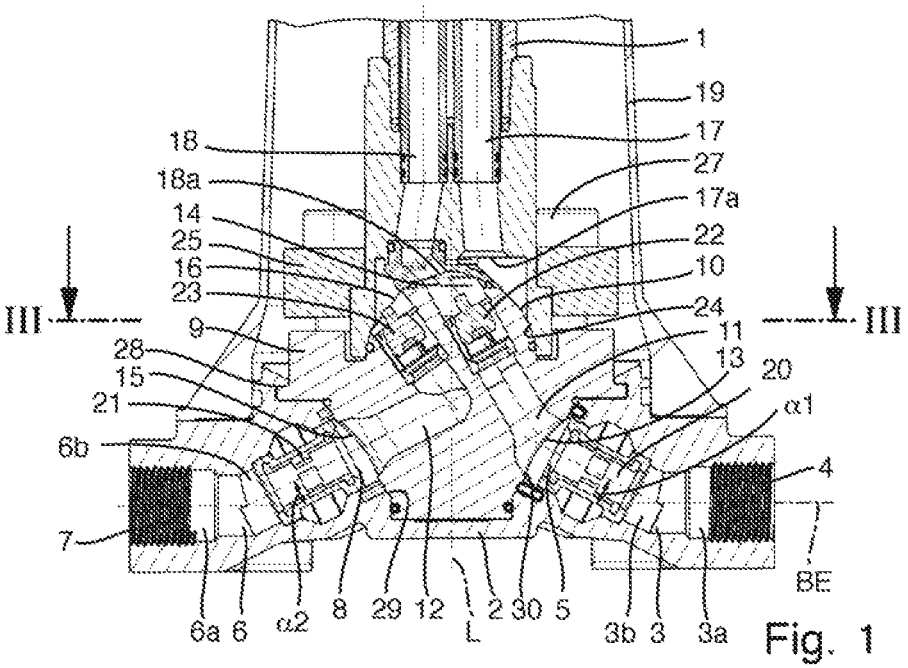

(58) Field of Classification Search
USPC ..... 285/361, 396, 402; 137/625.41, 315.01, 137/315.12, 15.18, 15.21
See application file for complete search history.

(56) References Cited

U.S. PATENT DOCUMENTS

| | | | | |
|---|---|---|---|---|
| 5,947,147 | A | 9/1999 | Gnauert et al. | |
| 6,006,784 | A * | 12/1999 | Tsutsui | E03C 1/0403 137/359 |
| 6,047,722 | A | 4/2000 | Cordes et al. | |
| 6,626,208 | B2 * | 9/2003 | Chen | F16K 15/063 137/100 |
| 7,445,024 | B2 * | 11/2008 | Paterson | E03C 1/057 137/549 |
| 2015/0369392 | A1 * | 12/2015 | Wilson | E03C 1/02 137/15.08 |

FOREIGN PATENT DOCUMENTS

| | | | |
|---|---|---|---|
| DE | 196 22 368 | A1 | 12/1997 |
| DE | 19622368 | A1 | 12/1997 |
| DE | 19627571 | A1 | 1/1998 |
| DE | 10 2007 030153 | A1 | 1/2009 |
| DE | 102007030153 | A1 | 1/2009 |
| DE | 102009040191 | A1 | 3/2011 |
| DE | 10 2010 030 661 | A1 | 12/2011 |
| DE | 10 2011 082120 | A1 | 3/2013 |
| DE | 10 2012 201 699 | A1 | 8/2013 |
| DE | 20 2016 100 225 | U1 | 2/2016 |
| EP | 1 006 241 | A1 | 6/2000 |

OTHER PUBLICATIONS

Office Action dated Dec. 4, 2018 (in Chinese Language) for Chinese Patent Application No. 201710675203.4, with English translation of Office Action and Search Report, issued by the National Intellectual Property Administration, P.R. China.

European Search Report issued by the European Patent Office (Munich), dated May 8, 2018, for European Patent Application No. EP17184892; 16 pages.

Office Action issued in connection with corresponding German patent application No. 10 2016 214 777.3, dated Jul. 25, 2017, 7 pages.

* cited by examiner

CONNECTION SOCKET FOR SANITARY FITTING WITH FLOOR-STANDING FAUCET COLUMN

The invention relates to a connection socket for a sanitary fitting with a floor-standing faucet column, wherein the connection socket comprises a socket bottom body with a bottom body fluid channel that contains a bottom body inlet and a bottom body outlet, and comprises a socket top removably attached to the socket bottom body, wherein the socket top contains a top-side connection surface for the faucet column and a top fluid channel which contains a top inlet that is connected in fluid communication with the bottom body outlet when the socket top is in an operating position, and contains a top outlet discharging at the faucet column connection surface.

The connection socket typically serves for connecting the free-standing or floor-standing sanitary fitting by way of the bottom-side faucet column end thereof to one or more water supply connections of the building, e.g. to a bottom-side cold-water connection and a hot-water connection of a water supply installation of the building. Such connection sockets are on the market in various designs, for example for connecting sanitary fittings in the form of free-standing mixer fittings for bathtubs and of free-standing shower-column mixer fittings.

Laid-open publication DE 10 2009 040 191 A1 discloses such a connection socket in the form of a flush-mounted body having a fixed bearing part as a socket bottom body and a movable bearing part as a socket top, wherein the two bearing parts have a spherical cap shape such that a mutually complementary alignment is realized. For the removable attachment of the faucet column to the flush-mounted body, use is made there of a clamping element in the form of a slotted clamping ring having a wedge-shaped cross section with which said clamping ring can be inserted into a correspondingly conically tapering receptacle of the movable bearing part. Following the attachment of the faucet column to the movable bearing part and vertical alignment of the faucet column, the clamping ring is screwed to the movable bearing part, whereupon the faucet column can be aligned together with the movable bearing part. Finally, the movable bearing part is fixed to the fixed bearing part by means of screws.

It is an object of the invention to provide a connection socket of the type mentioned at the beginning, with which a sanitary fitting can be connected with its floor-standing faucet column particularly advantageously to a water supply, such as a cold-water and/or hot-water connection of the building.

The invention achieves this and other objects by providing a connection socket configured for use in a sanitary fitting with a floor-standing faucet column, said connection socket comprising a socket bottom body including a bottom body fluid channel with a bottom body inlet and a bottom body outlet, and a socket top removably attached to the socket bottom body having a top-side faucet column connection surface and a top fluid channel, which top fluid channel has a top inlet connected in fluid communication with the bottom body outlet, when the socket top is in an operating position, and a top outlet discharging on the faucet column connection surface. According to one aspect of the invention, a sound absorber element is disposed in the bottom body fluid channel of the socket bottom body of the connection socket, which element is insertable and extractable via the bottom body outlet, that is to say the sound absorber element can be inserted through the bottom body outlet into this bottom body fluid channel and if need be can also be extracted therefrom again, for example for maintenance purposes or for replacing a defective sound absorber element.

According to a further aspect of the invention, a backflow preventer element that is insertable and extractable via the top outlet is disposed in the top fluid channel of the socket top of the connection socket, in other words, the backflow preventer element can be inserted through the top outlet into this top fluid channel and if need be can be extracted therefrom again, for example for maintenance purposes or for replacing a defective backflow preventer element.

According to a further aspect of the invention, the socket top is attached to the socket bottom body so as to be turnable between the operating position, in which the top fluid channel is connected in fluid communication via its top inlet to the bottom body fluid channel via the bottom body outlet thereof, and a blocking position, wherein, in said blocking position, the fluid communication of the top inlet with the bottom body outlet and thus the fluid communication of the top fluid channel with the bottom body fluid channel is blocked. In the blocking position of the socket top, it is therefore possible for maintenance or assembly work to be carried out on the socket top and/or on the faucet column mounted thereon in floor-standing arrangement, without it being necessary to block the fluid supply to the socket bottom body, for example at a shut-off device, in the building, of an associated water supply.

All the specified aspects certainly contribute, in themselves and in any corresponding combinations, to making it possible according to the invention for a sanitary fitting to be connected with its floor-standing faucet column to a water supply in a particularly advantageous manner, wherein said supply may in particular be a cold-water and/or hot-water connection of the building. Thus, in corresponding embodiments of the invention, the sound absorber element is advantageously integrated in the socket bottom body. Analogously, in corresponding embodiments of the invention, the backflow preventer element is advantageously integrated in the socket top. In corresponding embodiments of the invention, it is possible for the backflow preventer element to be extracted or replaced, in that the socket top is turned to its blocking position, whereupon the floor-standing faucet column can be dismounted from the socket top and subsequently the backflow preventer element can be extracted from the socket top via the top outlet or, if it is disposed in the faucet column, from the latter. It is then possible for a new backflow preventer element to be inserted into the top fluid channel or into the faucet column, and for the faucet column to be fastened to the socket top again. Finally, the socket top is turned back to its operating position in order to re-establish the fluid communication from the socket bottom body to the socket top, and thus to the faucet column.

In one development of the invention, the top-side connection surface of the socket bottom body, to which surface the faucet column can be removably attached, is designed so as to have a spherical cap shape. In corresponding embodiments, this connection surface has a semicircular shape, i.e., the shape of a hemisphere, or is formed so as to have a spherical-cap shape at least in a corresponding surface portion. This includes the possibility that this connection surface may be formed by a capped spherical segment that is flat on top. This, in conjunction with a correspondingly spherical-cap-shaped assembly surface at the faucet column, allows corresponding tilting mobility of the faucet column in relation to the connection socket in order for it to be possible to align the faucet column vertically before it is ultimately fixed to the socket bottom body. This spherical-cap-shaped coupling of the faucet column to the connecting socket can be realized with the required tightness without any great effort.

In one development of the invention, the sound absorber element is disposed in an output-side section of the bottom body fluid channel, wherein this output-side section extends in a manner inclined at an angle of less than 70° in relation to an input-side section of the bottom body fluid channel, wherein this input-side section is bottom-plane parallel, that is to say parallel to a bottom plane which is horizontal and thus perpendicular to the vertical faucet column. This represents an advantageous integration of the sound absorber element into the socket bottom body.

In one development of the invention, the socket bottom body and the socket top have corresponding frustoconical abutment surfaces, on which the bottom body outlet and the top inlet are located. In this case, the longitudinal axis of this frustoconical shape can act as the turning axis for the turning of the socket top in relation to the socket bottom body between the operating position and the blocking position in order selectively to bring the top inlet into fluid communication with the bottom body outlet or to stop this fluid communication, in that the top inlet is turned into the region of the bottom body outlet or turned out of said region.

In one development of the invention, the socket top is removably attached to the socket bottom body by means of a bayonet connection, wherein the socket top is turnable in relation to the socket bottom body, due to the bayonet connection, between the operating position and a dismounting position. The dismounting position has in this case a greater turning angle distance from the operating position than the blocking position, and the blocking position is a reversible intermediate position. This has the advantageous effect that, proceeding from the operating position, the socket top is firstly turned to the blocking position, which the user perceives as a reversible intermediate position, wherein this should be understood as being a position which can be defined by a sudden change in the actuation resistance, for example as an engaging step or a stop, and can be moved past by way of a suitable measure such that the socket top can be turned further as far as the dismounting position. Such a measure can be realized, for example, by means of a locking pin to be removed or the like, or a locking means which can be disengaged by an increased turning force. This ensures that the socket top can only be dismounted from the socket bottom body when the fluid communication between the socket bottom body and the socket top has already been blocked.

In one development of the invention, the socket bottom body includes two separate bottom body fluid channels, each with a respective bottom body inlet and a respective bottom body outlet, and, analogously, the socket top includes two separate top fluid channels, each with a respective top inlet and a respective top outlet. This development is suitable in particular for the connection of sanitary mixer fittings with separate cold-water and hot-water supplies via respectively one of the specified fluid channels in the socket bottom body and in the socket top.

In a further configuration, a respective sound absorber element that is insertable and extractable via the associated bottom body outlet is disposed in each of the two bottom body fluid channels. Additionally or alternatively, in a further configuration, a backflow preventer element that is insertable and extractable via the associated top outlet is disposed in each of the two top fluid channels. Additionally or alternatively, in a further configuration, in the blocking position of the socket top, the fluid communication between each of the two top inlets and the assigned bottom body outlet is blocked. All of these configurations are advantageous especially also for sanitary mixer fittings with separate cold-water and hot-water supplies. The abovementioned advantageous properties for the bottom body fluid channel and the top fluid channel and for the blocking function apply in this case for both bottom body fluid channels and both top fluid channels.

Advantageous embodiments of the invention are described in the following text and illustrated in the drawings, in which:

FIG. 1 shows a longitudinal sectional view of a connection socket, with a mounted floor-standing faucet column, in a socket operating position.

Figure 2:
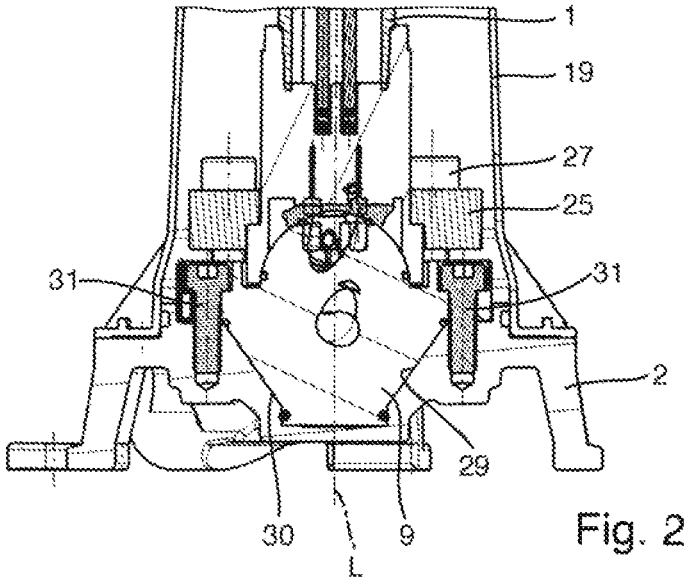
Figure 3:
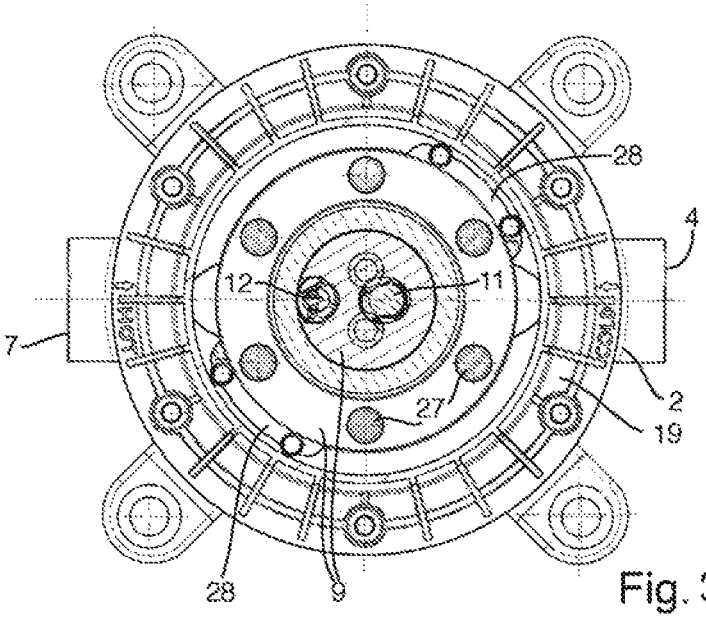
Figure 4:
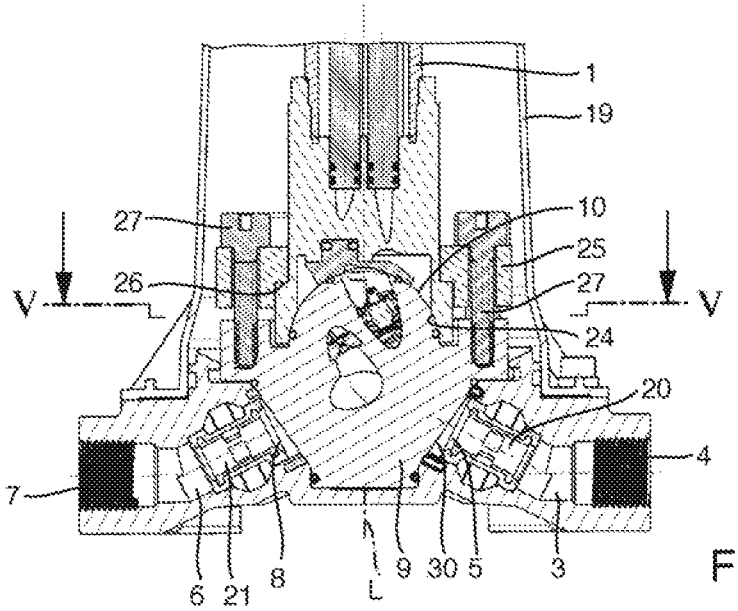
Figure 5:
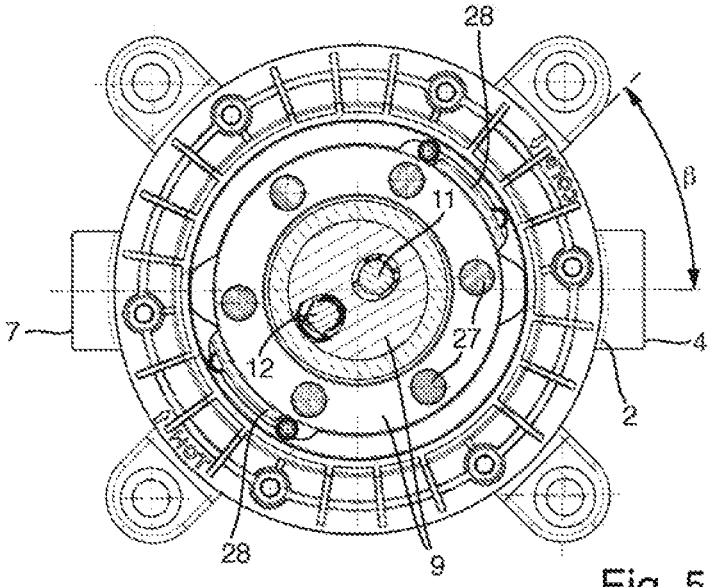
Figure 6:
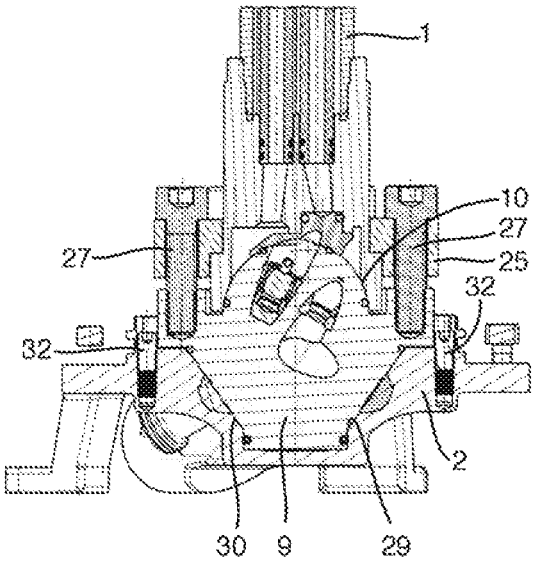
Figure 7:
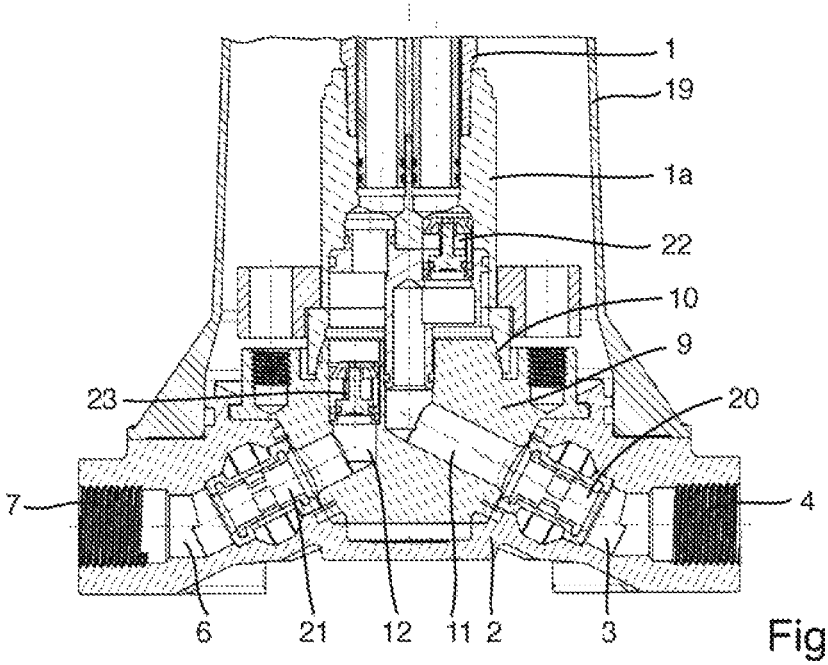
Figure 8:
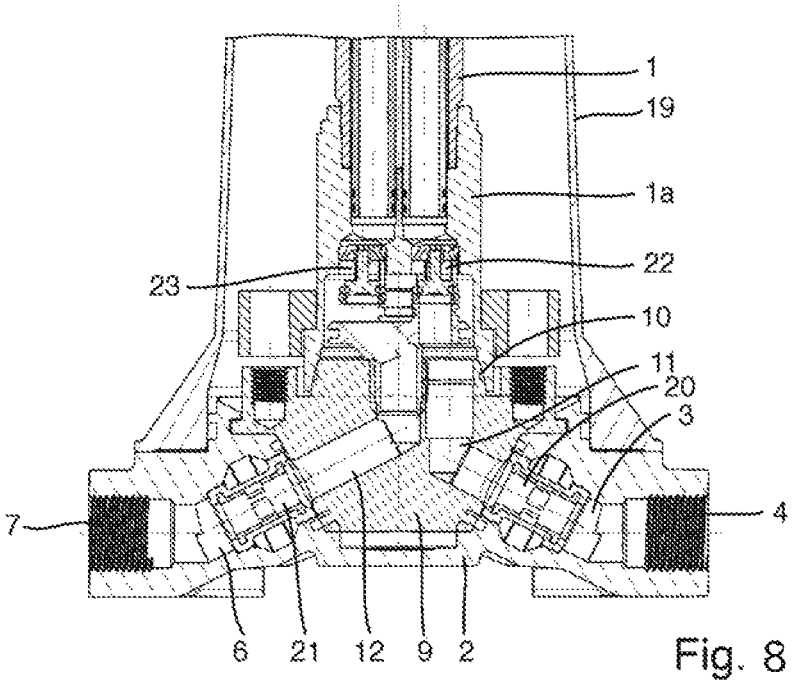

FIG. 2 shows a longitudinal sectional view of the connection socket in FIG. 1 in another sectional plane, FIG. 3 shows a cross-sectional view along a line III-III in FIG. 1, FIG. 4 shows a longitudinal sectional view corresponding to FIG. 1 with the connection socket in a socket blocking position, FIG. 5 shows a cross-sectional view along a line V-V in FIG. 4, FIG. 6 shows a longitudinal sectional view of the connection socket in FIGS. 1 to 5 in yet another sectional plane, FIG. 7 shows a longitudinal sectional view corresponding to FIG. 1 for a socket variant with modified placement of backflow preventer elements, and FIG. 8 shows a longitudinal sectional view corresponding to FIGS. 1 and 7 with modified placement of backflow elements compared therewith.

The connection socket shown in FIGS. 1 to 6 is suitable, for example, for connecting a free-standing mixer fitting for a bathtub or for a shower-column arrangement or the like to a faucet column 1 removably attached to the connection socket. The connection socket comprises a socket bottom body 2, which includes a first bottom body fluid channel 3 with a first bottom body inlet 4 and a first bottom body outlet 5, and also a second bottom body fluid channel 6 with a second bottom body inlet 7 and a second bottom body outlet 8. Furthermore, the connection socket contains a socket top removably attached to the socket bottom body 2 and having a top-side faucet column connection surface 10 and also a first top fluid channel 11 and a second top fluid channel 12. The first top fluid channel 11 has a first top inlet 13 and a first top outlet 14 discharging at the faucet column connection surface 10. Likewise, the second top fluid channel 12 has a second top inlet 15 and a second top outlet 16 discharging at the faucet column connection surface.

The two bottom body fluid channels 3, 6 are formed, in the socket bottom body 2, so as to be fluidically separate from one another, and likewise, the two top fluid channels 11, 12 are formed, in the socket top 9, in a fluidically separate manner. In an operating position, shown in FIG. 1, of the socket top 9, the first top inlet 13 is connected in fluid communication with the first bottom body outlet 5, and the second top inlet 15 is connected in fluid communication with the second bottom body outlet 8. As a result, the first top fluid channel 11 is connected in fluid communication with the first bottom body fluid channel 3, and the second top fluid channel 12 is connected in fluid communication with the second bottom body fluid channel 6. The two bottom body inlets 4, 7 may be connected in particular to a cold-water connection or a hot-water connection of a domestic water supply or sanitary installation of the building such that cold water and hot water can be supplied separately to the faucet column 1 via the two fluidically separate connection socket channels which consist in each case of the bottom body fluid channel 3, 6 in question and the top fluid channel 11, 12 connected thereto. Correspondingly, the faucet column 1 has two separate lines or water guides 17, 18 with associated inlets 17*a*, 18*a* which are connected in fluid communication with the first top outlet 14 and the second top outlet 16, respectively. The water guides 17, 18 lead in a conventional manner (not shown) to a head of the faucet column, in which head an associated mixer unit or a fitting unit for controlling the water quantity and the cold-water/warm-water mixing ratio is situated.

The connection socket is connected to the sanitary domestic installation in a conventional manner below a floor level, and is preferably covered by a cover cap 19 which extends in a likewise conventional manner (not shown here) as far as a floor level, such as a bathroom tile level or shower-room floor level, or slightly above this, and is optionally covered by a cover rose which the upwardly-continuing faucet column 1 surrounds.

As can be seen further from FIG. 1, a respective sound absorber element 20, 21 is disposed in each of the two bottom body fluid channels 3, 6 and can be inserted into the bottom body fluid channel 3, 6 in question and extracted therefrom again via the associated first or second bottom body outlet 13, 15 if the socket top 9 has been detached from the socket bottom body 2. For the sound absorber elements 20, 21, those of conventional design are usable. In the case of the connection socket according to FIG. 1, the sound absorber elements 20, 21 are especially disposed in an output-side section 3*b*, 6*b* of the bottom body fluid channel 3, 6 in question, wherein the output-side section 3*b*, 6*b* extends in each case in a manner inclined at an angle $\alpha 1$, $\alpha 2$ of less than 70° in relation to a bottom-plane parallel input-side section 3*a*, 6*a* of the respective bottom body fluid channel 3, 6. Preferably, this oblique angle $\alpha 1$, $\alpha 2$ is less than 45°, and in the example shown it lies in the range between 25° and 30°.

A backflow preventer element 22, 23 of conventional design is disposed in each of the two top fluid channels 11, 12 and can be inserted into the top fluid channel 11, 12 in question and extracted therefrom again via the associated first or second top outlet 14, if the faucet column 1 has been demounted from the socket top 9.

The top-side faucet column connection surface 10 of the socket top 9 can, as shown, advantageously have a spherical cap shape in order to allow, to a corresponding extent, tilting of the faucet column 1 with its longitudinal axis in relation to a longitudinal axis L of the socket top 9, and thus vertical alignment of the faucet column 1. For this purpose, the faucet column 1 has on its underside a correspondingly spherical-cap-shaped connection surface 24. In the aligned state, the faucet column 1 can then be fixed by means of a fixing ring 25, which acts on a ring shoulder 26 of the faucet column 1, and screw connections 27 on the socket top 9, as can be seen in particular from FIG. 4.

In the example shown in FIG. 1, the socket top 9 is attached to the socket bottom body 2 so as to be turnable by means of a bayonet connection 28 between the operating position shown in FIG. 1 and a blocking position. In the blocking position, the fluid communication of the respective top inlet 13, 15 with the corresponding bottom body outlet 5, 8 is blocked. FIGS. 4 and 5 show the connection socket in the blocking position, while FIGS. 1 to 3 show the connection socket in the operating position. In the exemplary embodiment shown, the socket bottom body 2 and the socket top 9 have for this purpose corresponding frustoconical abutment surfaces 29, 30, on which the bottom body outlets 5, 8 and the top inlets 13, 15, respectively, are located. Preferably, the socket top 9 is secured in the operating position in that it is additionally removably fixed, for example by way of screw connections 31 as shown in FIG. 2, to the socket bottom body 2. This fixing is released if the socket top 9 is to be turned in relation to the socket bottom body 2.

The turning of the socket top 9 in relation to the socket bottom body 2 from the operating position to the blocking position and back occurs over a turning angle range which is sufficient for turning the top inlets 13, 15 completely out of from the region of the bottom body outlets 5, 8. The turning of the socket top 9 occurs about its longitudinal axis L as the turning axis, wherein the faucet column 1 can be turned along therewith if it is attached to the socket top 9. In the example shown, the turning angle range between the operating position and the blocking position is discernible from a comparison of FIGS. 3 and 5, and, as can be seen therefrom, is approx. 35°, represented by an angle $\beta$ in FIG. 5.

Since, as a consequence, in the blocking position of the socket top 9, the fluid channels 11, 12 thereof are blocked in relation to the bottom body fluid channels 3, 6 connected to the water supply, the fluid supply to the socket top 9, and thus also to the faucet column 1, is then interrupted, and it is possible for repair or maintenance work to be performed on the faucet column 1 or on the socket top 9, without having to shut off water elsewhere, for example at an upstream shut-off valve of the sanitary installation in the building. In particular, in the blocking position of the socket top 9, it is possible for the faucet column 1 to be detached from the socket top 9 by releasing the fixing 27, and subsequently for the two or one of the two backflow preventer elements 22, 23 to be extracted from the socket top 9 and if appropriate replaced by new backflow preventer elements.

For repair or maintenance of the sound absorber elements 20, 21, the socket top 9 is dismounted from the socket bottom body 2, whereupon the sound absorber elements 20, 21 are accessible via the bottom body outlets 5, 8 in question, and can be repaired or replaced. For this purpose, the socket top 9 is turnable about its longitudinal axis L in relation to the socket bottom body 2, due to the bayonet connection, between the operating position according to FIGS. 1 to 3 and a dismounting position, wherein the dismounting position has a greater turning angle distance from the operating position than the blocking position, and wherein the blocking position is a surmountable intermediate position, for example in the form of a passable locking means or of a releasable stop. In the example shown in FIGS. 1 to 6, the blocking position is defined as a releasable stop by screw-in stop pins 32 which are visible from FIG. 6, wherein the stop pins 32 are screwable from the socket top 9 into the socket bottom body 2 and act as a releasable stop for the turning movement, by way of the bayonet connection 28, in the blocking position. After screwing out the stop pins 32, it is consequently possible for the socket top 9 to be turned in relation to the socket bottom body 2 beyond the blocking position to the dismounting position. In the dismounting position, the bayonet connection 28 is released, and so the socket top 9 can be detached from the socket bottom body 2.

FIGS. 7 and 8 illustrate two variants of the exemplary embodiment in FIGS. 1 to 6, wherein, for the sake of easier understanding, the same reference signs are used for identical and functionally equivalent elements, and it is possible in this respect to make reference to the above explanations for FIGS. 1 to 6, and so, in the following text, only the differences are addressed in greater detail.

In the exemplary embodiment in FIG. 7, the backflow preventer element 22 is disposed in a lower region 1*a*, which is modified in this respect, of the faucet column 1. Furthermore, the channel guide of the two top fluid channels 11, 12 is slightly modified, as can be seen from FIG. 7 compared with FIG. 1. Correspondingly, the spherical-cap-shaped faucet column connection surface 10 of the socket top 9 is formed by a capped spherical segment that is flat on top instead of a semicircular shape as in the example in FIG. 1.

In the exemplary embodiment in FIG. 8, both backflow preventer elements 22, 23 are disposed in the lower region 1*a* of the fitting column 1 instead of in the socket top 9 as in the example of FIGS. 1 to 6. In turn, the two top fluid channels 11, 12 are modified in their extent in relation to that in the exemplary embodiments in FIG. 7 or in FIGS. 1 to 6, as can be seen from a comparison of FIG. 8 with FIG. 7 or FIG. 1.

In further exemplary embodiments of the invention, which are not shown, a sound absorber element is disposed only in one of the two bottom body fluid channels or there are no sound absorber elements there. Furthermore, the invention includes exemplary embodiments (not shown) in which the turnability of the socket top in relation to the socket bottom body is realized not by way of a bayonet connection but by way of another conventional turn connection, for example with the use of a suitable rotary slotted link guide. The invention furthermore includes exemplary embodiments in which the socket top is attached to the socket bottom body so as to be turnable only between the operating position and the blocking position, without being turned further into a dismounting position, and also exemplary embodiments in which the socket top is removably attached to the socket bottom body in a rigid manner, without being able to be turned in relation thereto.

As the exemplary embodiments shown and explained above make clear, the invention provides a connection socket with which sanitary fittings with a floor-standing faucet column can be connected to an associated water supply in a very advantageous manner.

The invention claimed is:

1. A connection socket for a sanitary fitting, wherein the connection socket is configured for a floor-standing faucet column, said connection socket comprising:

a socket bottom body, including a bottom body fluid channel with a bottom body inlet and a bottom body outlet, a socket top removably attached to the socket bottom body having a top-side faucet column connection surface and a top fluid channel, which top fluid channel has a top inlet connected in fluid communication with the bottom body outlet, when the socket top is in an operating position, and a top outlet discharging on the faucet column connection, wherein the socket top is attached on the socket bottom body so as to be turnable between the operating position and a blocking position, wherein in the blocking position the fluid communication of the top inlet with the bottom body outlet is blocked, and wherein the faucet column connection surface has a spherical cup shape configured to allow selective tilting mobility of the faucet column in relation to the connection socket.

2. The connection socket according to claim 1, further comprising at least one of a sound absorber element disposed in the bottom body fluid channel, the sound absorber element being insertable and extractable via the bottom body outlet, and a backflow preventer element disposed in the top fluid channel, the backflow preventer element being insertable and extractable via the top outlet.

3. The connection socket according to claim 2, wherein the sound absorber element is disposed in an output-side section of the bottom body fluid channel, the output-side section extending at an angle of less than 70° inclined in relation to a bottom plane parallel input-side section of the bottom body fluid channel.

4. The connection socket according to claim 1, wherein the socket bottom body and the socket top have corresponding frustoconical abutment surfaces on which the bottom body outlet and the top inlet are located.

5. The connection socket according to claim 1, wherein the socket top is removably attached to the socket bottom body by means of a bayonet connection, wherein the socket top is turnable in relation to the socket bottom body due to the bayonet connection, between the operating position and a disassembling position, wherein the disassembling position has a greater turning angle distance to the operating position than the blocking position, and wherein the blocking position is a reversible intermediate position.

6. The connection socket according to claim 1, wherein the socket bottom body includes two separate bottom body fluid channels each with a respective bottom body inlet and a respective bottom body outlet, and the socket top includes two separate top fluid channels each with a respective top inlet and a respective top outlet.

7. The connection socket according to claim 6, wherein in each of the two bottom body fluid channels a respective sound absorber element is disposed and is insertable and extractable via the associated bottom body outlet.

8. The connection socket according to claim 6, wherein in each of the two top fluid channels, a backflow preventer element is disposed and is insertable and extractable via said respective top outlet.

9. The connection socket according to claim 6, wherein in the blocking position of the socket top, the fluid communication of each of the two top inlets with the respective said bottom body outlet is blocked.

10. A connection socket for a sanitary fitting, wherein the connection socket is configured for a floor-standing faucet column, said connection socket comprising:

a socket bottom body, including a bottom body fluid channel with a bottom body inlet and a bottom body outlet, a socket top removably attached to the socket bottom body having a top-side faucet column connection surface and a top fluid channel, which top fluid channel has a top inlet connected in fluid communication with the bottom body outlet, when the socket top is in an operating position, and a top outlet discharging on the faucet column connection, wherein the socket top is attached on the socket bottom body so as to be turnable between the operating position and a blocking position, wherein in the blocking position the fluid communication of the top inlet with the bottom body outlet is blocked, and wherein the socket bottom body and the socket top have corresponding frustoconical abutment surfaces on which the bottom body outlet and the top inlet are located.

11. The connection socket according to claim 10, further comprising at least one of a sound absorber element disposed in the bottom body fluid channel, the sound absorber element being insertable and extractable via the bottom body outlet, and a backflow preventer element disposed in the top fluid channel, the backflow preventer element being insertable and extractable via the top outlet.

12. The connection socket according to claim 10, wherein the faucet column connection surface has a spherical cup shape.

13. The connection socket according to claim 11, wherein the sound absorber element is disposed in an output-side section of the bottom body fluid channel, the output-side section extending at an angle of less than 70° inclined in relation to a bottom plane parallel input-side section of the bottom body fluid channel.

14. The connection socket according to claim 10, wherein the socket top is removably attached to the socket bottom body by means of a bayonet connection, wherein the socket top is turnable in relation to the socket bottom body due to the bayonet connection, between the operating position and a disassembling position, wherein the disassembling position has a greater turning angle distance to the operating position than the blocking position, and wherein the blocking position is a reversible intermediate position.

15. The connection socket according to claim 10, wherein the socket bottom body includes two separate bottom body fluid channels each with a respective bottom body inlet and a respective bottom body outlet, and the socket top includes two separate top fluid channels each with a respective top inlet and a respective top outlet.

16. The connection socket according to claim 15, wherein in each of the two bottom body fluid channels a respective sound absorber element is disposed and is insertable and extractable via the associated bottom body outlet.

17. The connection socket according to claim 15, wherein in each of the two top fluid channels, a backflow preventer element is disposed and is insertable and extractable via said respective top outlet.

18. The connection socket according to claim 15, wherein in the blocking position of the socket top, the fluid communication of each of the two top inlets with the respective said bottom body outlet is blocked.

* * * * *